US007179178B2

(12) United States Patent
Veilleux et al.

(10) Patent No.: US 7,179,178 B2
(45) Date of Patent: Feb. 20, 2007

(54) GOLF BALL DIMPLE PATTERN

(75) Inventors: Thomas A. Veilleux, Charlton, MA (US); Vincent J. Simonds, Brimfield, MA (US); Kevin J. Shannon, Springfield, MA (US)

(73) Assignee: Callaway Golf Company, Carlsbad, CA (US)

( * ) Notice: Subject to any disclaimer, the term of this patent is extended or adjusted under 35 U.S.C. 154(b) by 51 days.

(21) Appl. No.: 10/908,699

(22) Filed: May 23, 2005

(65) Prior Publication Data

US 2006/0264271 A1 Nov. 23, 2006

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,653,758 A * 3/1987 Solheim ..... 473/377
4,744,564 A 5/1988 Yamada
4,915,389 A 4/1990 Ihara
4,946,167 A 8/1990 Yamada
5,072,945 A 12/1991 Oka et al.
5,078,402 A 1/1992 Oka
5,123,652 A 6/1992 Oka
5,145,180 A 9/1992 Oka
5,156,404 A 10/1992 Oka et al.
5,249,804 A * 10/1993 Sanchez ..... 473/379
5,824,258 A 10/1998 Yamaguchi et al.
5,827,135 A 10/1998 Shimosaka et al.
5,840,351 A 11/1998 Inoue et al.
5,890,974 A 4/1999 Stiefel et al.
5,902,193 A 5/1999 Shimosaka et al.
5,906,551 A 5/1999 Kasashima et al.
5,908,359 A 6/1999 Shimosaka et al.
6,053,820 A 4/2000 Kasashima et al.
6,179,731 B1 1/2001 Shimosaka et al.
6,200,232 B1 3/2001 Kasashima et al.
6,241,627 B1 6/2001 Kasashima et al.
6,346,054 B1 2/2002 Shimosaka et al.
6,520,873 B2 * 2/2003 Inoue et al. ..... 473/378
6,527,653 B2 3/2003 Winfield et al.
6,533,684 B2 3/2003 Winfield et al.
6,551,203 B2 4/2003 Ogg
6,705,959 B2 * 3/2004 Morgan et al. ..... 473/383

* cited by examiner

*Primary Examiner*—Raeann Gorden
(74) *Attorney, Agent, or Firm*—Michael A. Catania; Elaine H. Lo

(57) ABSTRACT

A golf ball (20) having a non-planar parting line (25), a first false non-planar parting line (26*a*) and a second false non-planar parting line (26*b*). A first group 32 of parting dimples defines the non-planar parting line (25). A second group (33) of parting dimples defines the first false non-planar parting line (26*a*). A third group (34) of parting dimples defines the second false non-planar parting line (26*b*). A plurality of hexispheres (70) are defined by the non-planar parting line (25) the first false non-planar parting line (26*a*) and the second false non-planar parting line (26*b*).

9 Claims, 11 Drawing Sheets

GOLF BALL DIMPLE PATTERN

BACKGROUND OF THE INVENTION

1. Field of the Invention

The present invention relates to a dimple pattern for a golf ball. More specifically, the present invention relates to a dimple pattern for a golf ball that has false parting lines.

2. Description of the Related Art

Golf ball designers have been improving the symmetry of a golf ball for many years. Over the years, many golf ball surface patterns have been proposed to improve symmetry.

Yamada, U.S. Pat. No. 4,744,564, discloses a golf ball with smaller volume dimples near the poles than those close to the parting line.

Ihara, U.S. Pat. No. 4,915,389, discloses a golf ball with no parting line and dimples positioned on all great circles.

Yamada, U.S. Pat. No. 4,946,167 discloses a golf ball which improves symmetry by arranging dimples within a spherical triangles so as to be in a point or a line symmetrical relationship without intersecting the ridge lines of a complete geodesic 24-hedron.

Oka et al., U.S. Pat. No. 5,072,945, discloses a golf ball with a great circle zone along a parting line and dimple sin a P region and a S region being geometrically symmetric about the parting line.

Oka, U.S. Pat. No. 5,078,402, discloses a golf ball with dimples arranged to create four great circle zones.

Oka et al., U.S. Pat. No. 5,090,745, discloses a golf ball having a parting line and dimples formed thereon.

Oka, U.S. Pat. No. 5,123,652, discloses a golf ball with dimples arranged to create great circle zones with unintersecting dimples.

Oka, U.S. Pat. No. 5,145,180, discloses a golf ball with dimples arranged to create one great circle zone with unintersecting dimples, and 300 to 550 dimples formed on the golf ball.

Oka et al., U.S. Pat. No. 5,156,404, discloses a golf ball having a one great circle and four half great circles without intersecting dimples.

Yamaguchi, et al., U.S. Pat. No. 5,824,258, discloses a golf ball injection mold with gates along the parting line.

Shimosaka, et al., U.S. Pat. No. 5,827,135, discloses a golf ball dimple pattern with dimples intersecting all potential great circles.

Inoue et al., U.S. Pat. No. 5,840,351, discloses a mold with an offset center split which allows for dimples to be formed on a great circle of a golf ball.

Stiefel, et al., U.S. Pat. No. 5,890,974, discloses a tetrahedral dimple pattern with six dimple-free great circles.

Shimosaka, et al., U.S. Pat. No. 5,902,193, discloses a golf ball dimple pattern with dimples on the parting line.

Kasashima, et al., U.S. Pat. No. 5,906,551, discloses a golf ball dimple pattern with large volume dimples on the parting line.

Shimosaka, et al., U.S. Pat. No. 5,908,359, discloses a golf ball dimple pattern without dimples on the parting line, and which is designed to have equal ball hitting effects from the seam and the pole.

Kasashima, et al., U.S. Pat. No. 6,053,820, discloses a golf ball dimple pattern with two to five different dimples in a uniform arrangement.

Shimosaka, et al., U.S. Pat. No. 6,179,731, discloses a golf ball dimple pattern with dimples on the parting line and a raised portion.

Kasashima, et al., U.S. Pat. No. 6,200,232, discloses a golf ball dimple pattern with dimples intersecting all great circles, and the dimples arranged in a polyhedral arrangement.

Kasashima, et al., U.S. Pat. No. 6,241,627, discloses a golf ball dimple pattern with the dimples arranged in a regular icosahedron arrangement.

Shimosaka, et al., U.S. Pat. No. 6,346,054, discloses a golf ball dimple pattern with dimples equally distributed in spherical triangle arrangements.

Winfield, et al., U.S. Pat. No. 6,527,653, discloses a pentagonal hexecontahedron dimple pattern.

Winfield, et al., U.S. Pat. No. 6,533,684, discloses a phyllotaxis-based dimple pattern.

Ogg, U.S. Pat. No. 6,551,203, discloses a dimple pattern with 384 dimples covering 86% of the surface area of the golf ball.

There is still a need for a golf ball with improved symmetry.

BRIEF SUMMARY OF THE INVENTION

One aspect of the present invention is a golf ball including a plurality of non-partitioning dimples and a plurality of partitioning dimples. The plurality of partitioning dimples includes a first, group, a second group and a third group. The first group of the plurality of partitioning dimples is positioned about an equator of the golf ball to define a non-planar parting line for the golf ball. The first group of partitioning dimples has a first row of partitioning dimples and a second row of partitioning dimples offset from the first row of partitioning dimples. The second group of the plurality of partitioning dimples is preferably positioned around the golf ball to define a first false non-planar parting line for the golf ball. The second group of partitioning dimples has a third row of partitioning dimples and a fourth row of partitioning dimples offset from the third row of partitioning dimples. The first false non-planar parting line is preferably positioned approximately at an angle of sixty degrees to the non-planar parting line. The third group of the plurality of partitioning dimples is preferably positioned around the golf ball to define a second false non-planar parting line for the golf ball. The third group of partitioning dimples has a fifth row of partitioning dimples and a sixth row of partitioning dimples offset from the fifth row of partitioning dimples. The second false non-planar parting line is preferably positioned approximately at an angle of sixty degrees to the non-planar parting line.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is an equatorial front view of a golf ball only illustrating a first group of partitioning dimples.

DETAILED DESCRIPTION OF THE INVENTION

Figure 1:
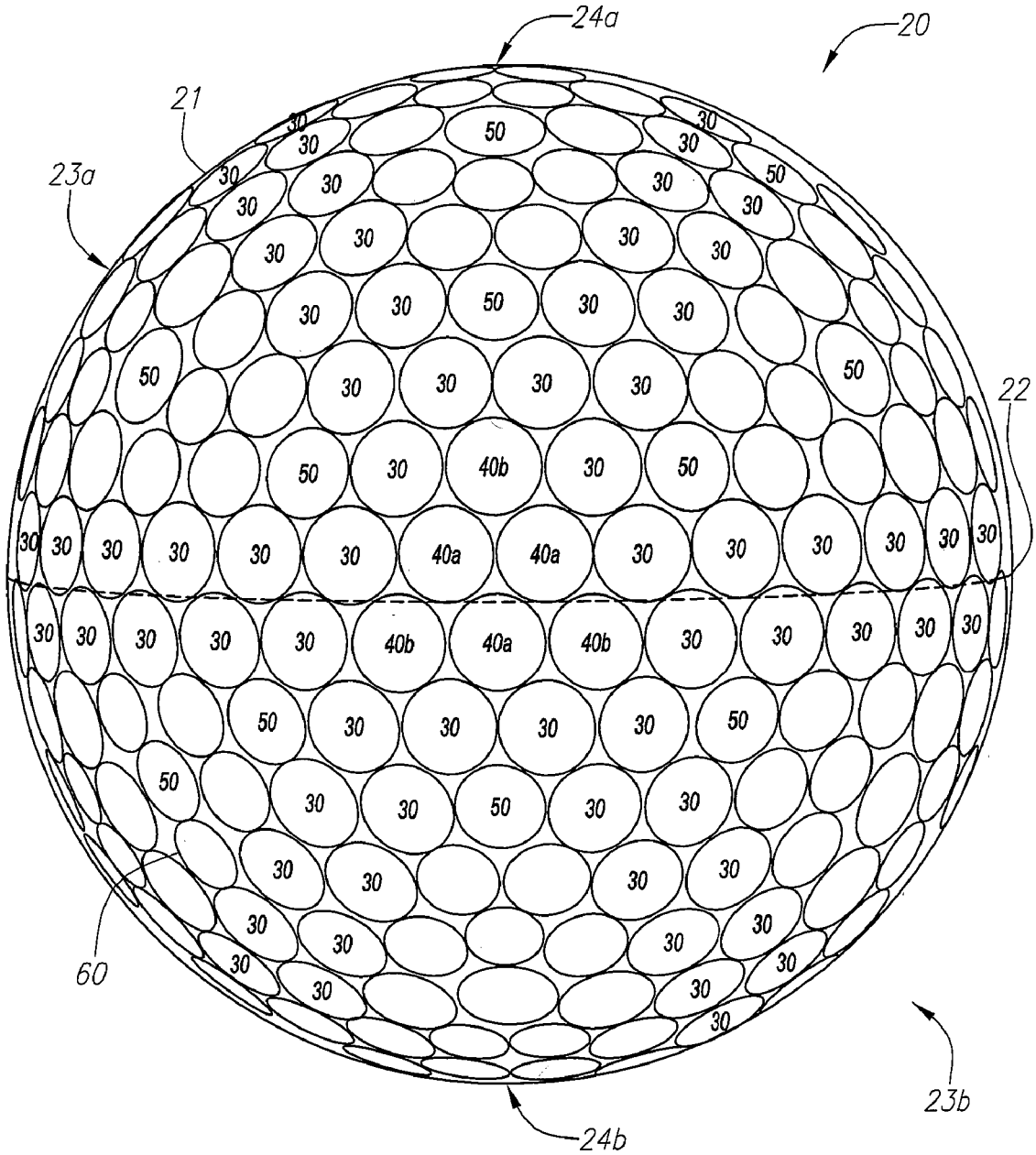
FIG. 1 is an equatorial front view of a preferred embodiment of a golf ball of the present invention.
Figure 2:
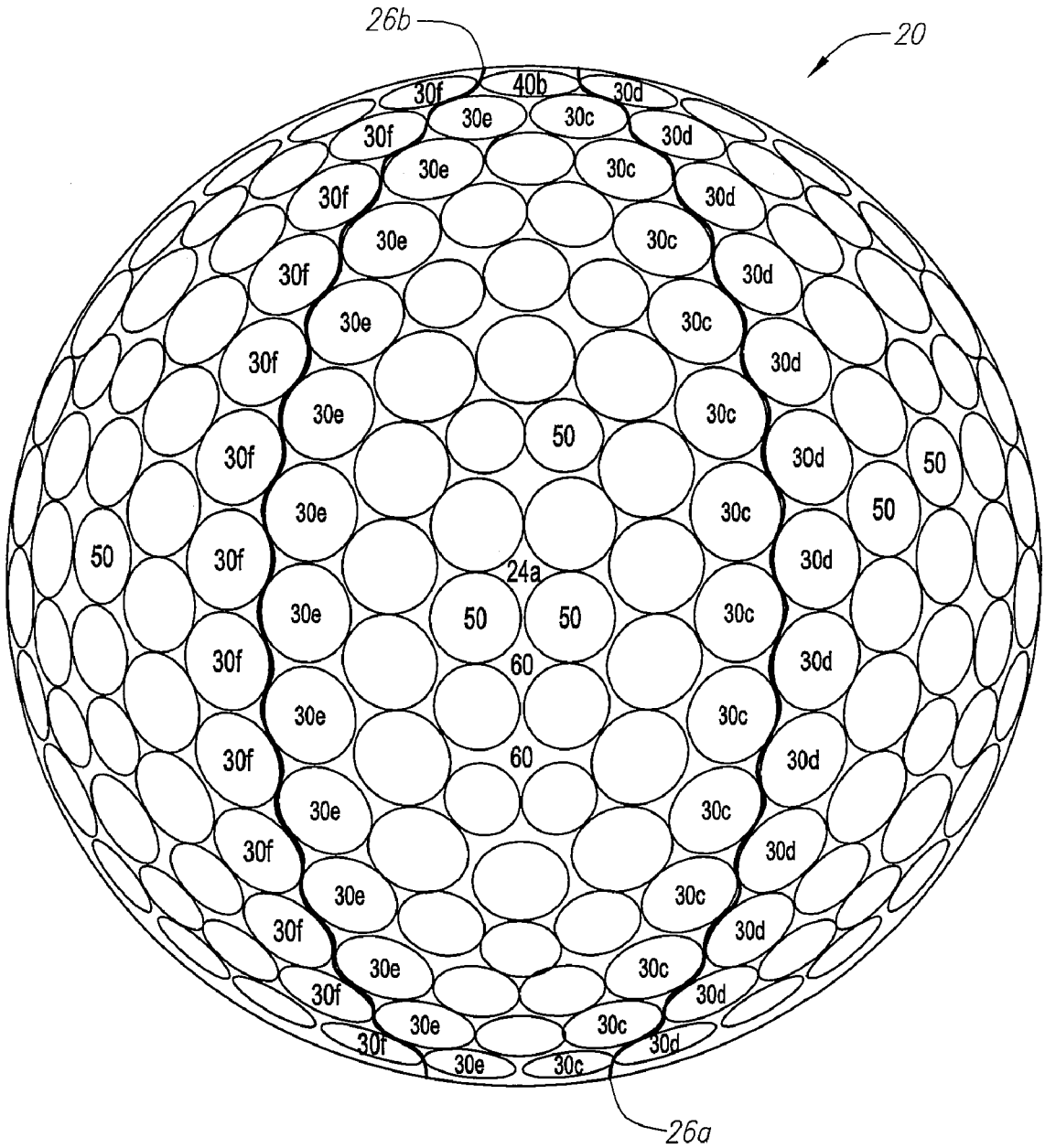
FIG. 2 is a polar view of the golf ball of FIG. 1.
Figure 3:
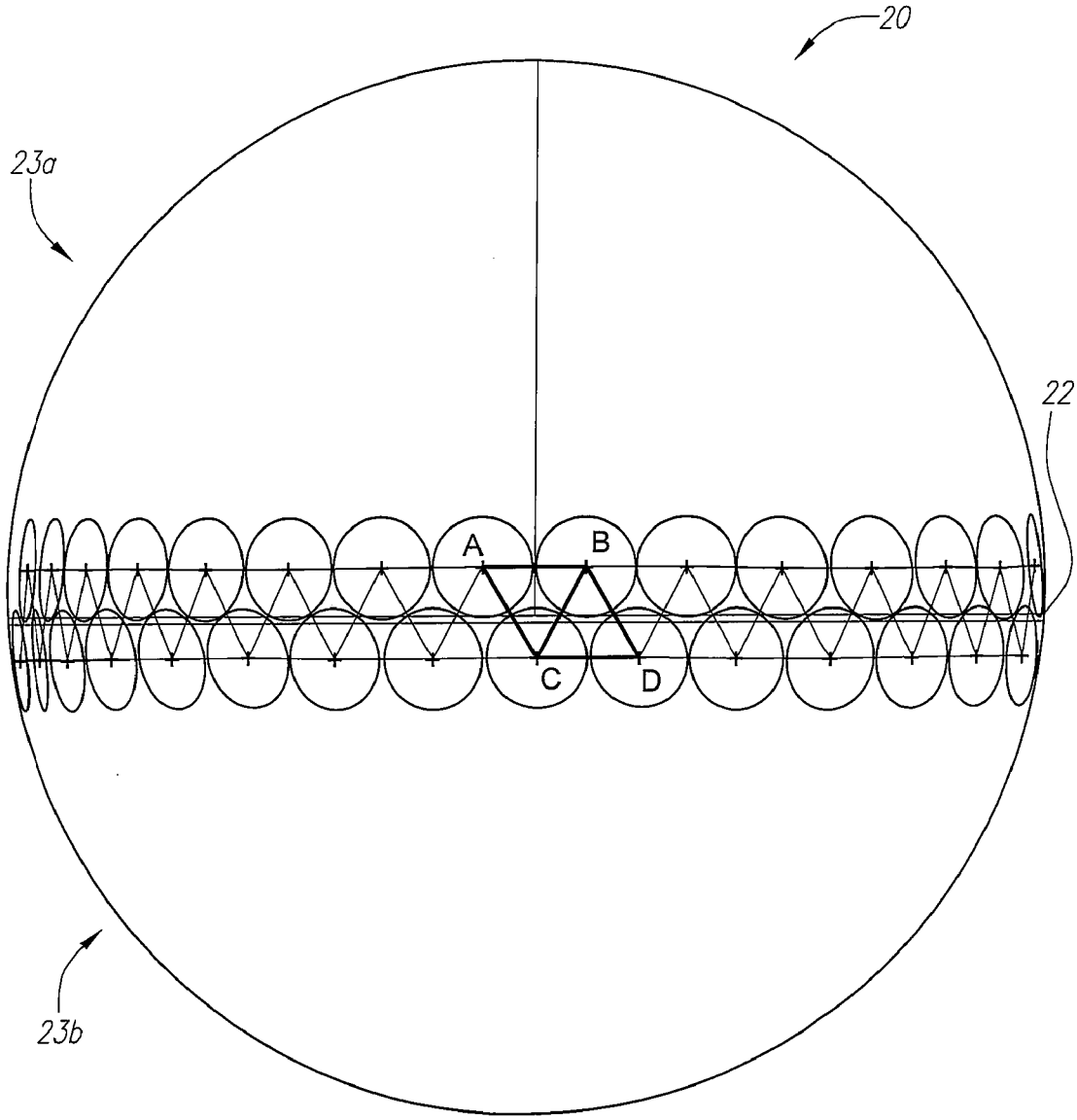
FIG. 3 is an equatorial front view of a golf ball illustrating only a first group of partitioning dimples.
Figure 4:
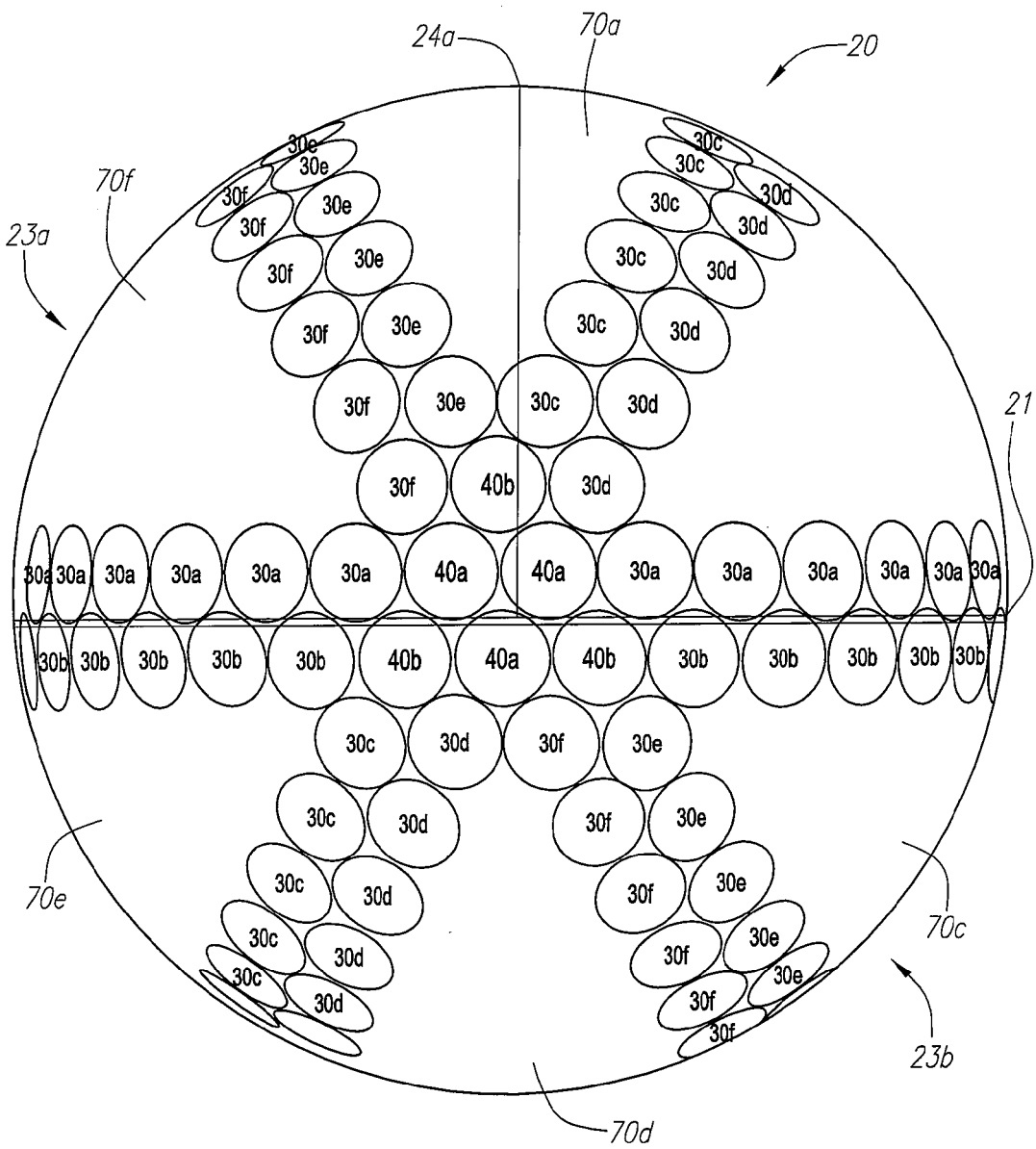
FIG. 4 is an equatorial front view of a golf ball only illustrating the partitioning dimples.

As shown in FIGS. 1 and 2, a golf ball is generally designated 20. The golf ball has a surface 21, an equator 22 dividing the surface 21 into a first hemisphere 23*a* and a second hemisphere 23*b*, a first pole 24*a* and a second pole 24*b*. The golf ball 20 is preferably a two-piece or three-piece golf ball. However, those skilled in the pertinent art will recognize that the golf ball 20 may be of any construction without departing from the scope and spirit of the present invention.

The golf ball 20 has an aerodynamic pattern on the surface 21. The aerodynamic pattern of the golf ball 20 preferably includes a plurality of partitioning dimples 30, a plurality of intersecting dimples 40, a plurality of other dimples and land area 60.

As shown in FIGS. 3–9, the plurality of partitioning dimples 30 preferably includes a first row of partitioning dimples 30*a*, a second row of partitioning dimples 30*b*, a third row of partitioning dimples 30*c*, a fourth row of partitioning dimples 30*d*, a fifth row of partitioning dimples 30*e*, and a sixth row of partitioning dimples 30*f*.

Figure 5:
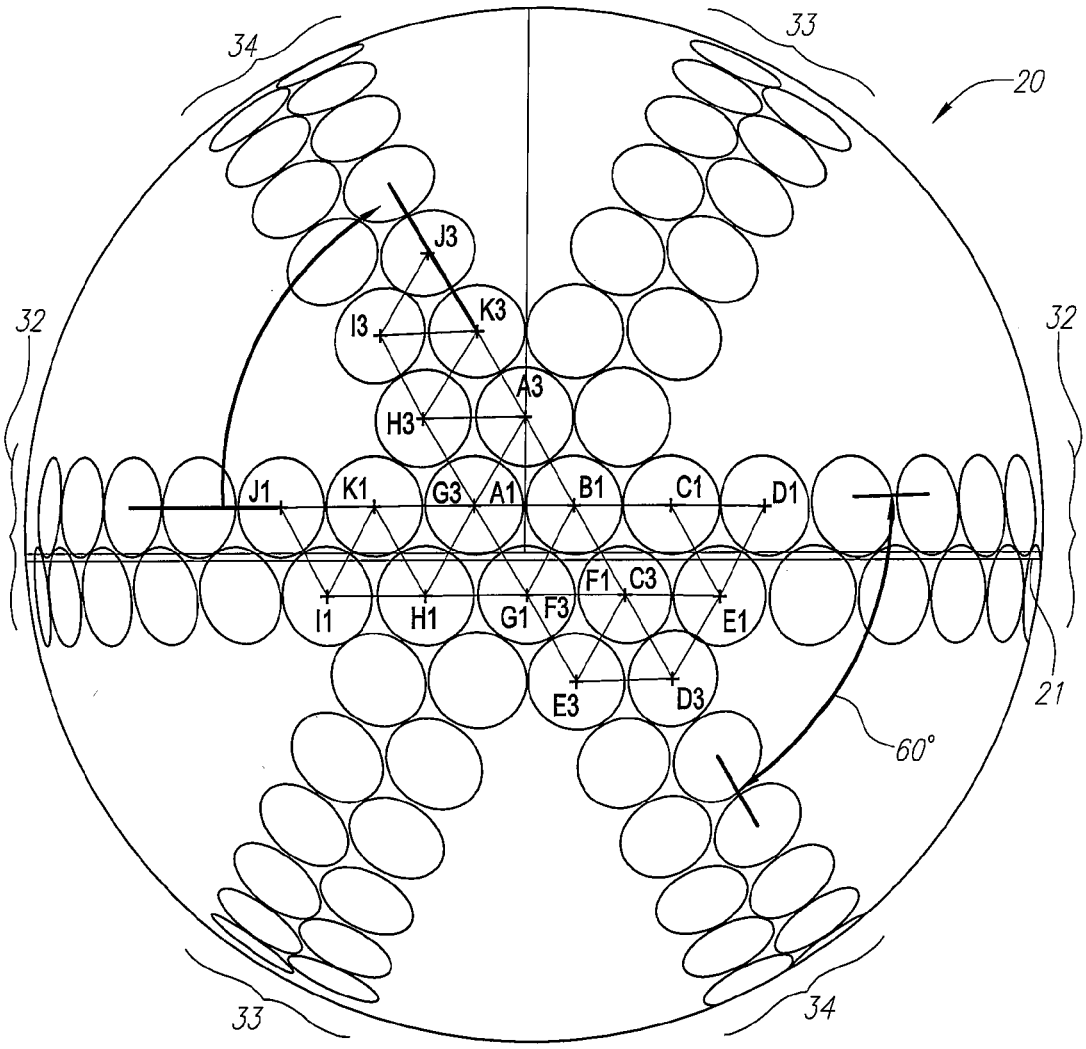
FIG. 5 is an equatorial front view of a golf ball only illustrating the partitioning dimples and the angles between two groups of partitioning dimples.
Figure 6:
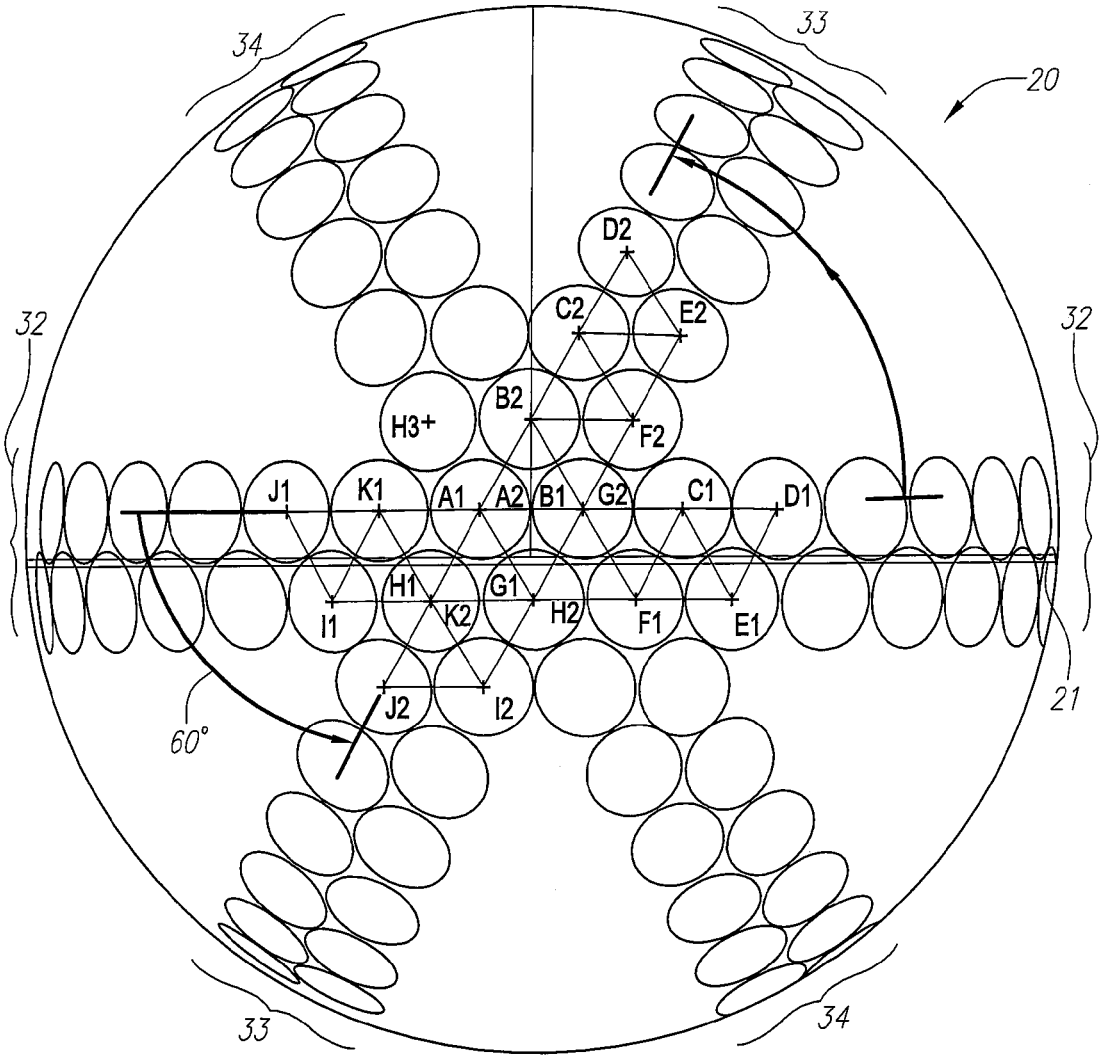
FIG. 6 is an equatorial front view of a golf ball only illustrating the partitioning dimples and the angles between two groups of partitioning dimples.
Figure 7:
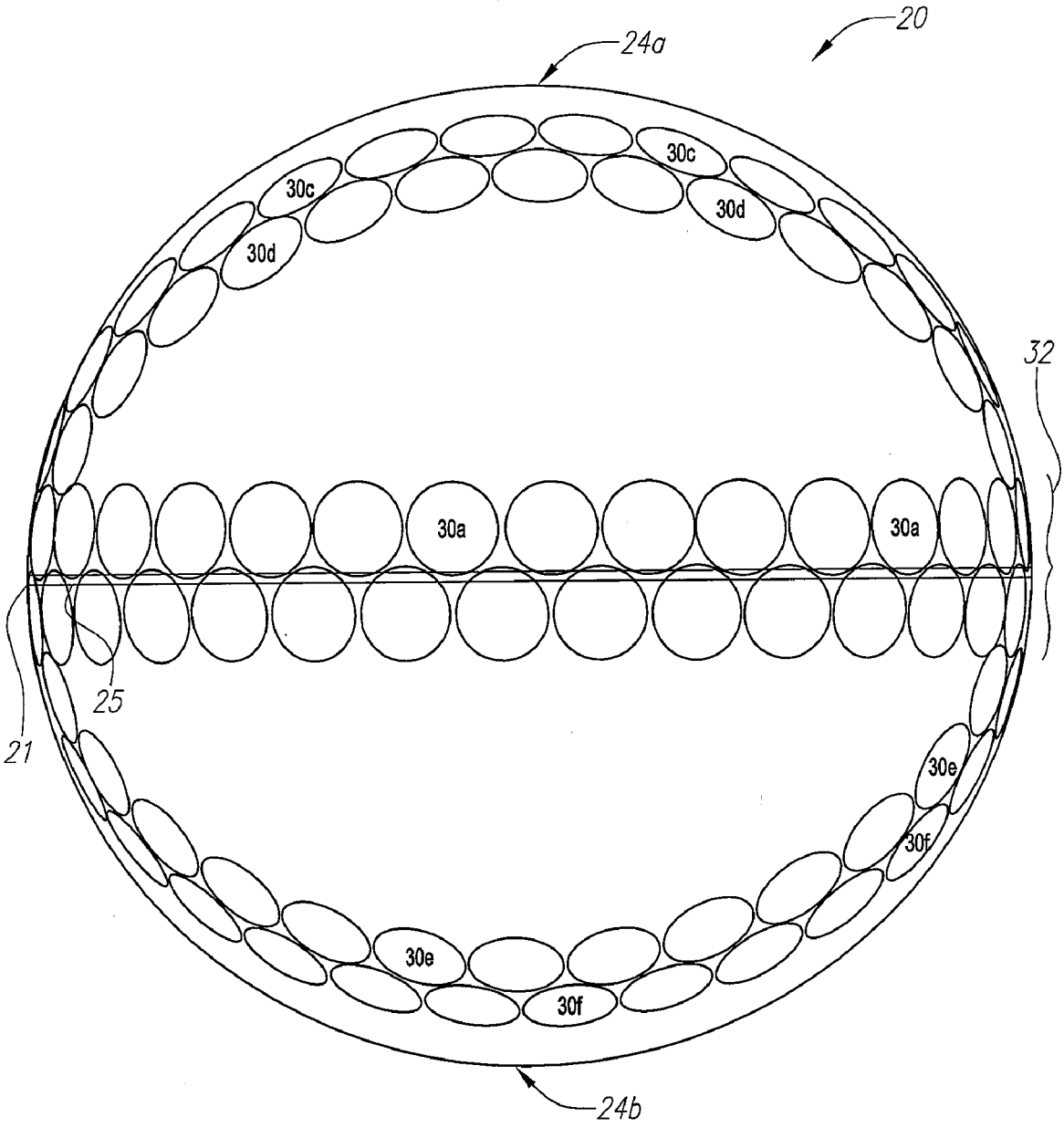
FIG. 7 is an equatorial side view of a golf ball only illustrating the partitioning dimples.

As shown in FIGS. 5–7, the first row of partitioning dimples 30*a* and the second row of partitioning dimples 30*b* generally define a first group of parting dimples 32. The third row of partitioning dimples 30*c* and the fourth row of partitioning dimples 30*d* generally define a second group of parting dimples 33. The fifth row of partitioning dimples 30*e* and the sixth row of partitioning dimples 30*f* generally define a third group of parting dimples 34. The first group of parting dimples 32 is generally positioned about the equator 22 of the golf ball 20. Each of the first group of parting dimples 32, the second group of parting dimples 33 and the third group of parting dimples 34 is positioned generally at an angle of sixty degrees relative to each other group of parting dimples 32, 33 and 34.

Figure 8:
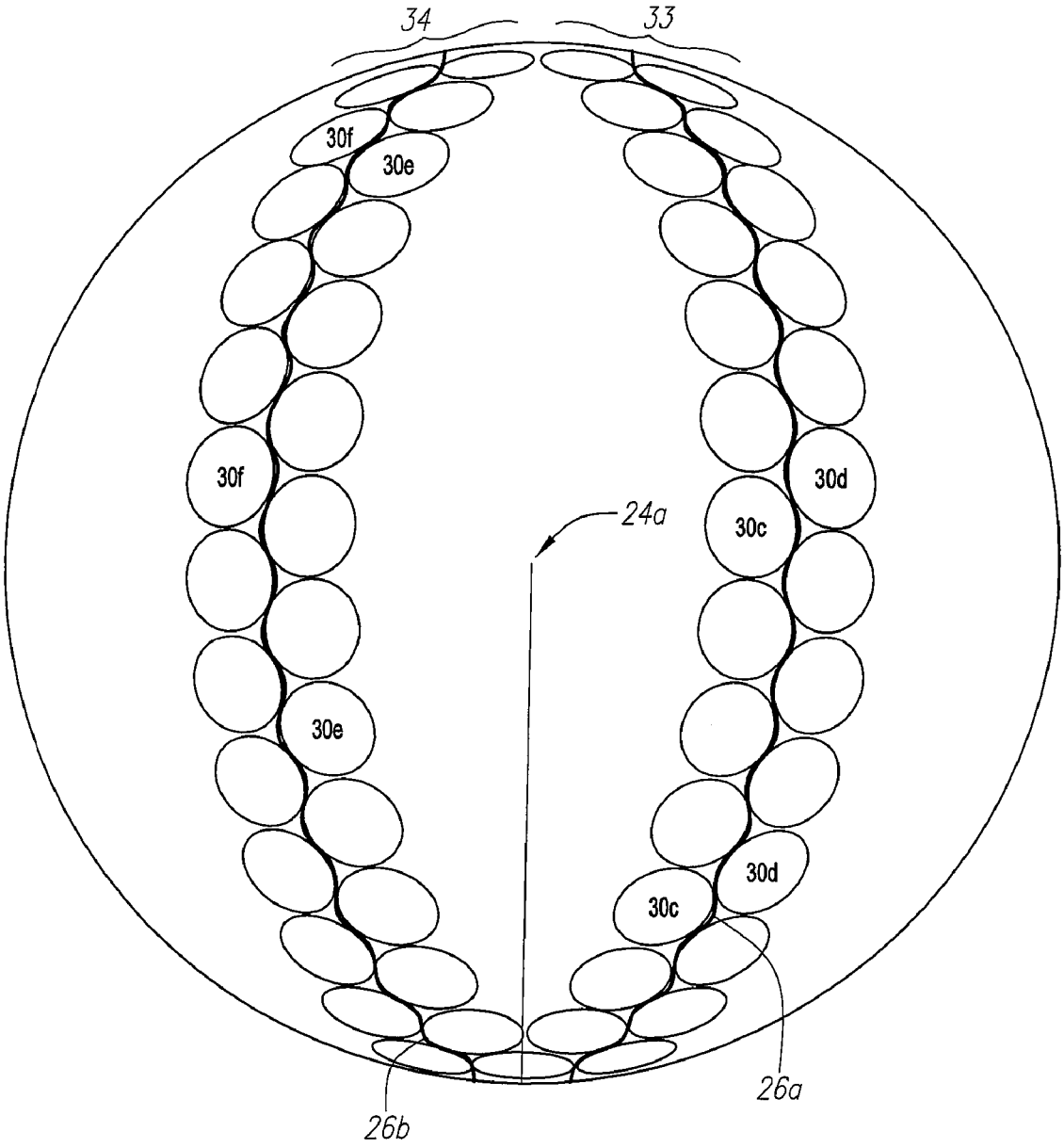
FIG. 8 is a polar view of a golf ball only illustrating the partitioning dimples.
Figure 9:
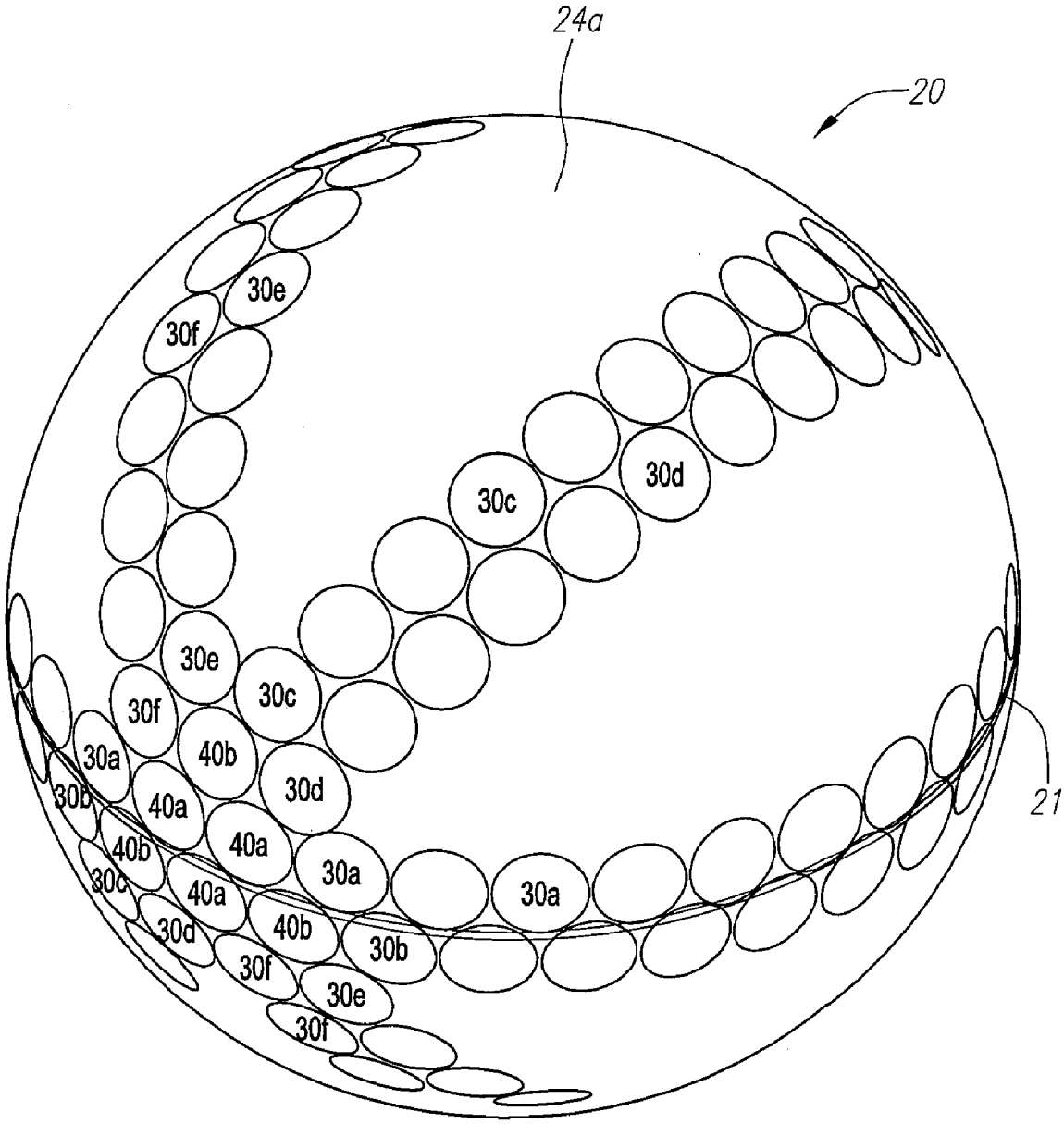
FIG. 9 is an equatorial top perspective view of a golf ball only illustrating the partitioning dimples.

As shown in FIGS. 7 and 8, the first group of parting dimples 32 generally defines a non-planar parting line 25. The second group of parting dimples 33 generally defines a first false non-planar parting line 26*a*. The third group of parting dimples 34 generally defines a second false non-planar parting line 26*b*. Each of the non-planar parting line 25, first false non-planar parting line 26*a* and second false non-planar parting line 26*b* is positioned generally at an angle of sixty degrees relative to each other.

Figure 12:
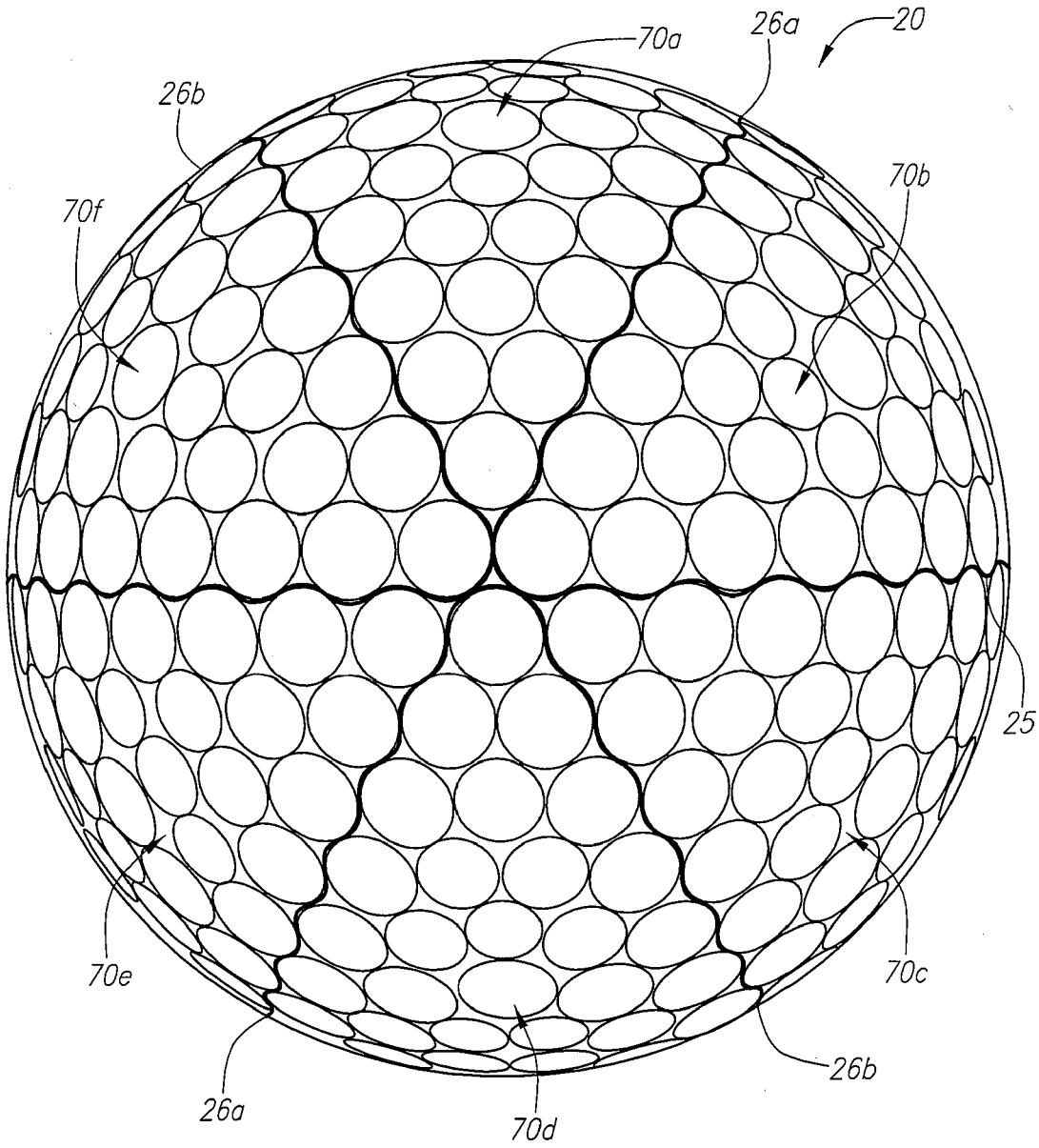
FIG. 12 is an equatorial front view of a preferred embodiment of a golf ball illustrating the non-planar partitioning line and false non-planar partitioning lines.

As shown in FIGS. 12, the non-planar parting line 25, the first false non-planar parting line 26*a*, and the second false non-planar parting line 26*b* define a plurality of hexispheres 70 preferably comprising a first hexisphere 70*a*, a second hexisphere 70*b*, a third hexisphere 70*c*, a fourth hexisphere 70*d*, a fifth hexisphere 70*e* and a sixth hexisphere 70*f*. The surface area of each of the hexispheres 70 is preferably equal. The number of non-partition dimples 50 of each of the hexispheres 70 is preferably equal.

As shown in FIG. 12, the first hexisphere 70*a* is defined by the first false non-planar parting line 26*a* and the second false non-planar parting line 26*b*. The second hexisphere 70*b* is defined by the non-planar parting line 25 and the first false non-planar parting line 26*a*. The third hexisphere 70*c* is defined by the non-planar parting line 25 and the second false non-planar parting line 26*b*. The fourth hexisphere 70*d* is defined by the first false non-planar parting line 26*a* and the second false non-planar parting line 26*b*. The fifth hexisphere 70*e* is defined by the non-planar parting line 25 and the first false non-planar parting line 26*a*. The sixth hexisphere 70*f* is defined by the non-planar parting line 25 and the second false non-planar parting line 26*b*. The first hexisphere 70*a*, the second hexisphere 70*b* and the sixth hexisphere 70*f* are preferably positioned in the first hemisphere 23*a* of the golf ball 20. The third hexisphere 70*c*, the fourth hexisphere 70*d* and the fifth hexisphere 70*e* are preferably positioned in the second hemisphere 23*b* of the golf ball 20. Each hexisphere 70 preferably has 32 to 40 non-partitioning dimples 50.

The plurality of non-partitioning dimples 50 and the plurality of partitioning dimples 30 preferably cover from 82% to 87% of a surface area of the golf ball 20, and more preferably cover 85% of the surface area of the golf ball 20. The plurality of non-partitioning dimples 50 and the plurality of partitioning dimples 30 combined preferably number from 360 dimples to 440 dimples, and most preferably 384 dimples. The plurality of partitioning dimples 30 preferably number from 132 dimples to 156 dimples. Each of the plurality of partitioning dimples 30 has a diameter ranging from 0.16 inch to 0.22 inch, and more preferably from 0.20 inch to 0.22 inch or 0.16 inch to 0.18 inch.

Figure 10:
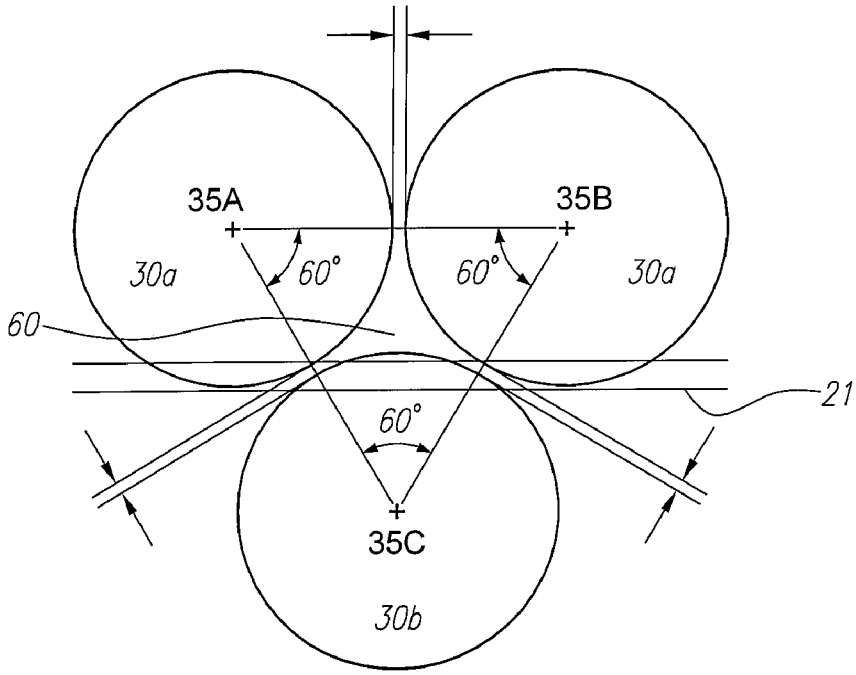
FIG. 10 is an isolated view of three adjacent partitioning dimples.

As shown in FIG. 10, an isosceles triangle is preferably formed by straight lines drawn between a center 35 of each of adjacent partitioning dimples 30. For example, a first line drawn from center 35*a* to center 35*b*, a second line drawn from center 35*b* to center 35*c*, and a third line drawn from center 35*c* to center 35*a* forms an isosceles triangle.

Figure 11:
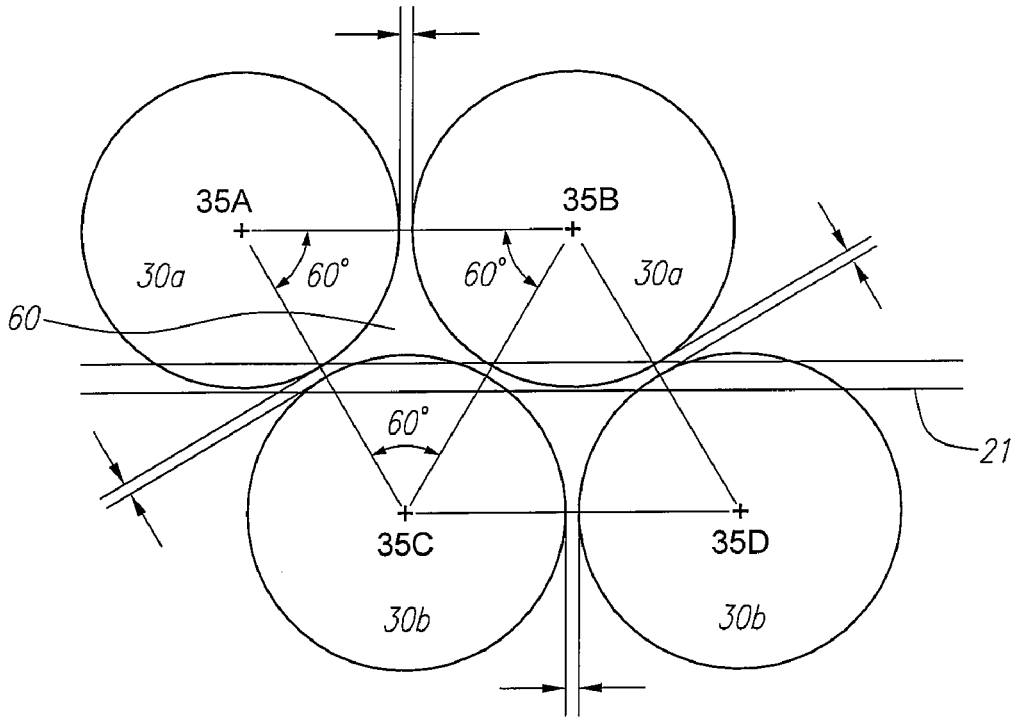
FIG. 11 is an isolated view of four adjacent partitioning dimples.

As shown in FIG. 11, an equal-sided parallelogram is preferably formed by straight lines drawn between a center 35 of each of adjacent partitioning dimples 30. For example, a first line drawn from center 35*a* to center 35*b*, a second line drawn from center 35*b* to center 35*c*, a third line drawn from center 35*c* to center 35*d* and a fifth line drawn from center 35*d* to center 35*a* forms an equal-sided parallelogram.

Table One illustrates various embodiments of the present invention.

| Partition Row Dimple Count | Partition Dimple Diameter | Total Partition Count | Filler Dimple Count Not in Partition | Total Count |
|---|---|---|---|---|
| 25 | 0.206 | 132 | 120 | 252 |
| 27 | 0.190 | 144 | 152 | 296 |
| 29 | 0.176 | 156 | 184 | 340 |
| 31 | 0.165 | 168 | 216 | 428 |
| 33 | 0.155 | 180 | 248 | 428 |
| 35 | 0.145 | 192 | 280 | 472 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf ball comprising:

a plurality of non-partitioning dimples; and a plurality of partitioning dimples comprising a first group of the plurality of partitioning dimples positioned about an equator of the golf ball to define a non-planar parting line for the golf ball, the first group of partitioning dimples having a first row of partitioning dimples and a second row of partitioning dimples offset from the first row of partitioning dimples, a second group of the plurality of partitioning dimples positioned around the golf ball to define a first false non-planar parting line for the golf ball, the second group of partitioning dimples having a third row of partitioning dimples and a fourth row of partitioning dimples offset from the third row of partitioning dimples, the first false non-planar parting line positioned approximately at an angle of sixty degrees to the non-planar parting line, and a third group of the plurality of partitioning dimples positioned around the golf ball to define a second false non-planar parting line for the golf ball, the third group of partitioning dimples having a fifth row of partitioning dimples and a sixth row of partitioning dimples offset from the fifth row of partitioning dimples, the second false non-planar parting line positioned approximately at an angle of sixty degrees to the non-planar parting line.

2. The golf ball according to claim 1 wherein the plurality of partitioning dimples further comprises a plurality of primary-intersecting dimples and a plurality of secondary-intersecting dimples, the primary-intersecting dimples defining an intersection of the first group, second group and third group of the plurality of partitioning dimples, and the secondary-intersecting dimples defining an intersection of at least two of the first group, second group and third group of the plurality of partitioning dimples.

3. The golf ball according to claim 1 wherein the plurality of non-partitioning dimples and the plurality of partitioning dimples cover from 82% to 87% of a surface area of the golf ball.

4. The golf ball according to claim 1 wherein the plurality of non-partitioning dimples and the plurality of partitioning dimples combined number from 360 dimples to 440 dimples.

5. The golf ball according to claim 1 wherein the plurality of non-partitioning dimples and the plurality of partitioning dimples combined number 384 dimples.

6. The golf ball according to claim 1 wherein the plurality of partitioning dimples number from 132 dimples to 156 dimples.

7. The golf ball according to claim 1 wherein each of the plurality of partitioning dimples has a diameter ranging from 0.16 inch to 0.22 inch.

8. The golf ball according to claim 1 wherein each of the plurality of partitioning dimples has a diameter ranging from 0.20 inch to 0.22 inch.

9. The golf ball according to claim 1 wherein each of the plurality of partitioning dimples has a diameter ranging from 0.16 inch to 0.18 inch.

* * * * *